US011649724B2

(12) United States Patent
Elhawary et al.

(10) Patent No.: US 11,649,724 B2
(45) Date of Patent: May 16, 2023

(54) FORMATION TESTING AND SAMPLING TOOL FOR STIMULATION OF TIGHT AND ULTRA-TIGHT FORMATIONS

(71) Applicants: Halliburton Energy Services, Inc., Houston, TX (US); Saudi Arabian Oil Company, Dhahran (SA)

(72) Inventors: Wael Soliman Elhawary, Dhahran (SA); Mustapha Berkane, Dhahran (SA); Ghulam Jeelani, Dhahran (SA); Colin Douglas Tisdale, Dhahran (SA); Mahmoud Eid Selim, Dhahran (SA); Endurance Oziegbe Ighodalo, Dhahran (SA)

(73) Assignees: Halliburton Energy Services, Inc., Houston, TX (US); Saudi Arabian Oil Company, Dhahran (SA)

( * ) Notice: Subject to any disclaimer, the term of this patent is extended or adjusted under 35 U.S.C. 154(b) by 75 days.

(21) Appl. No.: 17/184,296

(22) Filed: Feb. 24, 2021

(65) Prior Publication Data

US 2021/0404332 A1 Dec. 30, 2021

Related U.S. Application Data

(60) Provisional application No. 63/044,191, filed on Jun. 25, 2020.

(51) Int. Cl.
*E21B 43/27* (2006.01)
*E21B 49/10* (2006.01)
(Continued)

(52) U.S. Cl.
CPC ..... *E21B 49/008* (2013.01); *E21B 33/127* (2013.01); *E21B 43/26* (2013.01); *E21B 47/06* (2013.01)

(58) Field of Classification Search
CPC ..... E21B 49/08; E21B 49/081; E21B 49/082; E21B 49/088; E21B 49/10; E21B 43/27
See application file for complete search history.

(56) References Cited

U.S. PATENT DOCUMENTS 7,140,436 B2 11/2006 Grant et al.
7,234,521 B2 * 6/2007 Shammai ..... E21B 49/081 166/264

(Continued)

OTHER PUBLICATIONS

Omokaro, Felix; Mushrafi, Nedhal; Soliman, Wael Ali; Rourke, Marvin Peter; Salim, Mahmoud Eid (). [Society of Petroleum Engineers SPE Middle East Oil and Gas Show and Conference—Manama, Bahrain (Sep. 25, 2011)] SPE Middle East Oil and Gas Show and Conference—Challenges of Wireline-Formation Testing and Fluid Sampling in Tight, Low-Permeability Gas Reservoirs: A Case Study from Saudi Arabia.

*Primary Examiner* — Kenneth L Thompson
(74) *Attorney, Agent, or Firm* — John Wustenberg; C. Tumey Law Group PLLC

(57) ABSTRACT

A fluid sampling tool and method for fluid sampling in an ultra-tight or tight formation. The tool may include a packer assembly that includes one or more inflatable packers and one or more exhaust ports, a multi-chamber section that includes one or more sample chambers, and at least two storage sections that each contain a storage tank, wherein each storage tank holds a stimulation fluid. A method for performing a stimulation operation that includes disposing a fluid sampling tool into a well, moving the fluid sampling tool to a zone of interest, and isolating the zone of interest with a packer assembly on the fluid sampling tool. The method may further include performing a first pressure draw down and a first pressure build up, performing an injectivity test, and performing a sampling process.

19 Claims, 9 Drawing Sheets

(51) Int. Cl.

| | |
|---|---|
| ***E21B 49/00*** | (2006.01) |
| ***E21B 33/127*** | (2006.01) |
| ***E21B 43/26*** | (2006.01) |
| ***E21B 47/06*** | (2012.01) |

(56) References Cited

U.S. PATENT DOCUMENTS

| | | | | |
|---|---|---|---|---|
| 7,266,983 | B2 * | 9/2007 | Krueger | E21B 49/008 73/152.22 |
| 7,841,402 | B2 * | 11/2010 | Georgi | E21B 49/10 73/152.55 |
| 7,886,825 | B2 * | 2/2011 | Van Hal | E21B 36/008 166/302 |
| 8,245,781 | B2 * | 8/2012 | Ciglenec | E21B 49/10 166/305.1 |
| 8,283,174 | B2 * | 10/2012 | Van Hal | E21B 49/10 166/305.1 |
| 8,448,703 | B2 * | 5/2013 | Ross | E21B 49/10 166/250.1 |
| 9,534,478 | B2 * | 1/2017 | Corre | E21B 43/116 |
| 9,784,876 | B2 | 10/2017 | Quirein et al. | |
| 9,845,673 | B2 | 12/2017 | Gisolf et al. | |
| 9,976,073 | B2 * | 5/2018 | Salla | E21B 37/06 |
| 2012/0043080 | A1 | 2/2012 | Edwards | |
| 2020/0256769 | A1 * | 8/2020 | Al-Yami | E21B 33/124 |

* cited by examiner

FACE DISSOLUTION

CONICAL WORMHOLE

DOMINANT WORMHOLE

RAMIFIED WORMHOLES

UNIFORM DISSOLUTION

FORMATION TESTING AND SAMPLING TOOL FOR STIMULATION OF TIGHT AND ULTRA-TIGHT FORMATIONS

BACKGROUND

Wells may be drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials.

During drilling operations, sampling operations may be performed to collect a representative sample of formation or reservoir fluids (e.g., hydrocarbons) to further evaluate drilling operations and production potential, or to detect the presence of certain gases or other materials in the formation that may affect well performance.

Tight and ultra-tight reservoirs that are also known as secondary reservoirs are defined as all petroleum resources that must be produced economically from low permeability and low porosity reservoirs by stimulation treatment (e.g. acid stimulation, hydraulic fracturing or both combined) are referred to as tight oil, without limitations of lithology and oil quality. Due to the low porosity and permeability within these formations, current wireline formation testing tools are incapable of collecting representative hydrocarbon samples due to the inability of such reservoirs to flow naturally or efficiently.

BRIEF DESCRIPTION OF THE DRAWINGS

The features and advantages of certain embodiments will be more readily appreciated when considered in conjunction with the accompanying figures. The figures are not to be construed as limiting any of the preferred embodiments.

DETAILED DESCRIPTION

Figure 1A:
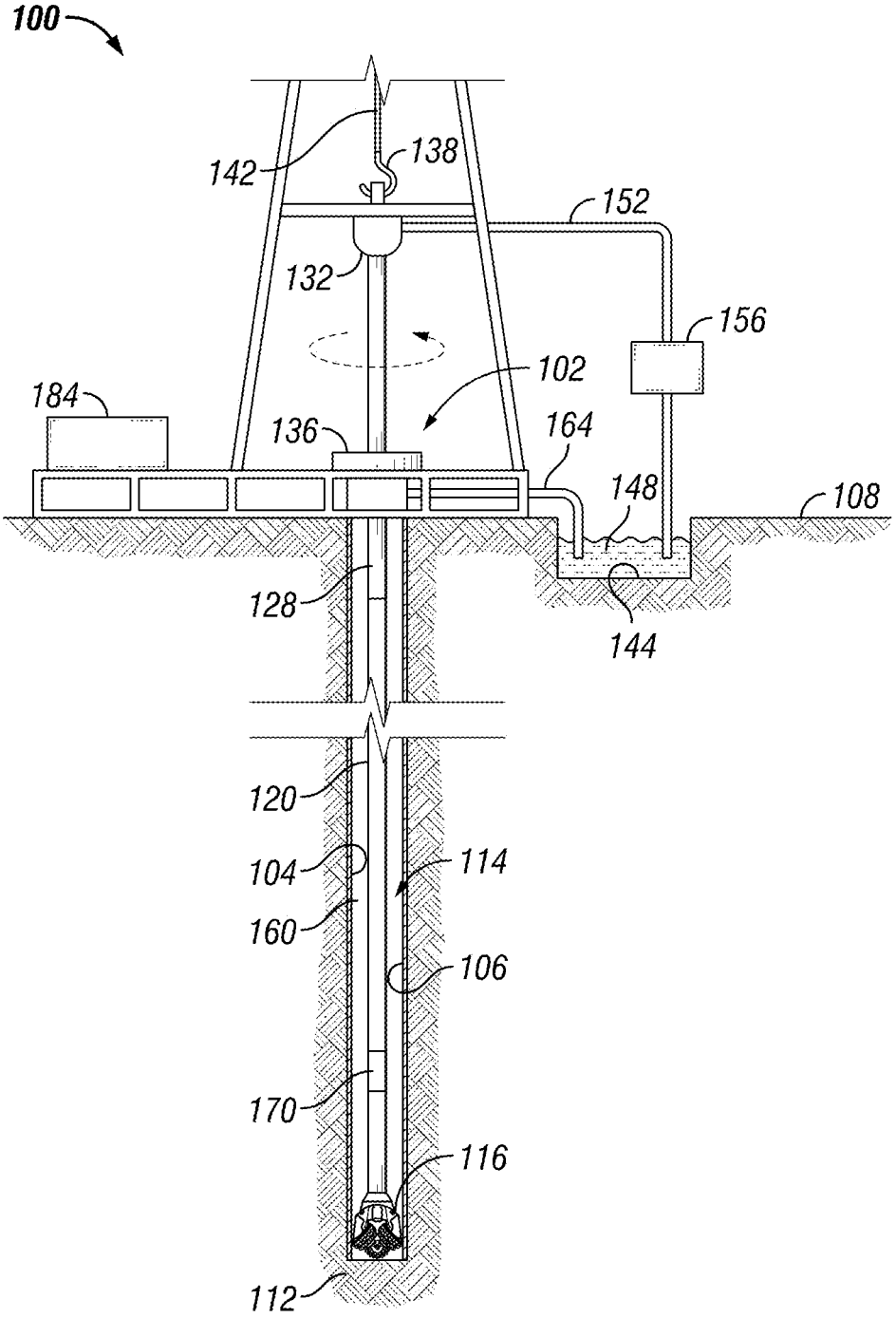
FIG. 1A illustrates a schematic view of a well in which an example embodiment of a fluid sample system is deployed.

The present disclosure relates to subterranean operations and, more particularly, embodiments disclosed herein provide methods and systems for capture and measurement of fluids and formation properties in an area of interest. Specifically, fluid and rock properties in an ultra-tight formation using a formation tester. An ultra-tight formation is defined as a formation that has characteristics of low permeability and low porosity. Generally, stimulation treatments (e.g. acid stimulation, hydraulic fracturing or both combined) must be utilized to remove the "tight oil" from the formation. Tight oil is defined as the oil resources that is preserved and accumulated in low porosity (<12%) and low permeability (<0.1 mD). In this range of porosity and permeability, wireline formation testing tools are not capable of collecting representative hydrocarbon samples due to the inability of such reservoirs to flow naturally or efficiently by its definition with all existing sampling tools technology in the market. Permeability and flow within a formation is found using the following equation for Darcy's law:

$$q = -\frac{K}{\mu}\Delta P \tag{1}$$

which shows the direct relation between permeability "K" and fluid flowing rate "q." Equation (1) includes μ, which represents fluid viscosity and further shows how a low K value will produce a high pressure drawdown (ΔP) and very low flowing rate "q," which may identify ultra-low mobility of fluids.

Ultra-low mobility in tight formations prevent conventional formation testers from obtaining both fluid and rock properties. Discussed below are systems and methods for a formation testing tool to address the needs specific to an ultra-tight formation or a tight formation that includes characteristics of ultra-low mobility of fluids. For example, the formation testing tool may be able to inject, flow-back, or place the stimulation fluid(s) facing the target formation with a controlled increase in pressure that may exceed or not exceed fracturing pressure, which is based on the type of stimulation operation. The utilization of a dual port straddle packer assembly controls the mode of operation to be used depending on the nature of the formation and stimulation ability. During operations, the formation testing tool may carry large volumes of stimulation fluid(s) within the formation testing tool with no interaction between the fluids and the carrying tanks. Additionally, the formation testing tool may have the ability to control the stimulation fluids characteristics by mixing the simulation fluids with inhibitor and/or catalyzers in-situ conditions in order to enhance the simulation fluids results and prevent corrosion effect on the formation testing tool from the simulation fluids. In other methods, the formation testing tool may use one or more combination logs including but not limited to open hole logs, caliper, corrosion, and cement image logs to optimize the perforation interval. For example, in a cased hole environment cement bond and casing imaging logs may be utilized for stimulation operations to ensure that the injected stimulation fluid is efficiently directed into the perforated formation and not leaking into a channel behind a casing in situations with poor zonal isolation. During operations, the logs may be utilized for evaluating zones of interest in an open hole environment to evaluate parameters such as, and not limited to, borehole profile and size, quality of the rock, etc. In addition, Pre and Post pressure build-up may be measured to evaluate the stimulation efficiency as a direct measurement.

The fluid sampling tools described herein may vary in design, but embodiments of the fluid sampling tools typically may include an inlet, an outlet, and a sampling chamber. Embodiments may further include two or more sampling chambers. The inlet and outlet may be fluidly connected to the fluid within the wellbore that is being extracted from a subterranean formation. In sampling operation, a fluid sample may be gathered into the sampling chamber from the formation for analysis.

The fluid sampling tools, systems and methods described herein may be used with any of the various techniques employed for evaluating a well, including without limitation wireline formation testing (WFT), measurement while drilling (MWD), and logging while drilling (LWD). The various tools and sampling units described herein may be delivered downhole as part of a wireline-delivered downhole assembly or as a part of a drill string. It should also be apparent that given the benefit of this disclosure, the apparatuses and methods described herein have applications in downhole operations other than drilling, and may also be used after a well is completed.

FIG. 1A illustrates a fluid sampling and analysis system 100 according to an illustrative embodiment used in a well 102 having a wellbore 104 that extends from a surface 108 of well 102 to or through a subterranean formation 112. While wellbore 104 is shown extending generally vertically into subterranean formation 112, the principles described herein are also applicable to wellbores that extend at an angle through subterranean formations 112, such as horizontal and slanted wellbores. For example, although FIG. 1A shows wellbore 104 that is vertical or low inclination, high inclination angle or horizontal placement of wellbore 104 and equipment is also possible. In addition, it should be noted that while FIG. 1A generally depicts a land-based operation, those skilled in the art should readily recognize that the principles described herein are equally applicable to subsea operations that employ floating or sea-based platforms and rigs, without departing from the scope of the disclosure.

Well 102 is illustrated with fluid sampling and analysis system 100 being deployed in a drilling assembly 114. In the embodiment illustrated in FIG. 1A, well 102 is formed by a drilling process in which a drill bit 116 is turned by a drill string 120 that extends from drill bit 116 to surface 108 of well 102. Drill string 120 may be made up of one or more connected tubes or pipes, of varying or similar cross-section. Drill string 120 may refer to the collection of pipes or tubes as a single component, or alternatively to the individual pipes or tubes that include the string. The term "drill string" is not meant to be limiting in nature and may refer to any component or components that are capable of transferring rotational energy from the surface of the well to the drill bit. In several embodiments, drill string 120 may include a central passage disposed longitudinally in drill string 120 and capable of allowing fluid communication between surface 108 of well 102 and downhole locations.

At or near surface 108 of well 102, drill string 120 may include or be coupled to a kelly 128. Kelly 128 may have a square, hexagonal, octagonal, or other suitable cross-section. In examples, kelly 128 may be connected at one end to the remainder of drill string 120 and at an opposite end to a rotary swivel 132. As illustrated, kelly 120 may pass through a rotary table 136 that is capable of rotating kelly 128 and thus the remainder of drill string 120 and drill bit 116. Rotary swivel 132 should allow kelly 128 to rotate without rotational motion being imparted to rotary swivel 132. A hook 138, cable 142, traveling block (not shown), and hoist (not shown) may be provided to lift or lower the drill bit 116, drill string 120, kelly 128 and rotary swivel 132. Kelly 128 and swivel 132 may be raised or lowered as needed to add additional sections of tubing to drill string 120 as drill bit 116 advances, or to remove sections of tubing from drill string 120 if removal of drill string 120 and drill bit 116 from well 102 is desired.

A reservoir 144 may be positioned at surface 108 and holds drilling fluid 148 for delivery to well 102 during drilling operations. A supply line 152 may fluidly couple reservoir 144 and the inner passage of drill string 120. A pump 156 may drive drilling fluid 148 through supply line 152 and downhole to lubricate drill bit 116 during drilling and to carry cuttings from the drilling process back to surface 108. After traveling downhole, drilling fluid 148 returns to surface 108 by way of an annulus 160 formed between drill string 120 and wellbore 104. At surface 108, drilling mud 148 may returned to reservoir 144 through a return line 164. Drilling mud 148 may be filtered or otherwise processed prior to recirculation through well 102.

FIB. 1B illustrates a schematic view of another embodiment of well 102 in which an example embodiment of fluid analysis system 100 may be deployed. As illustrated, fluid analysis system 100 may be deployed as part of a wireline assembly 115, either onshore of offshore. As illustrated, wireline assembly 115 may include a winch 117, for example, to raise and lower a downhole portion of wireline assembly 115 into well 102. As illustrated, fluid analysis system 100 may include fluid sampling tool 170 attached to winch 117. In examples, it should be noted that fluid sampling tool 170 may not be attached to winch 117. Fluid sampling tool 170 may be supported by rig 172 at surface 108.

Figure 1B:
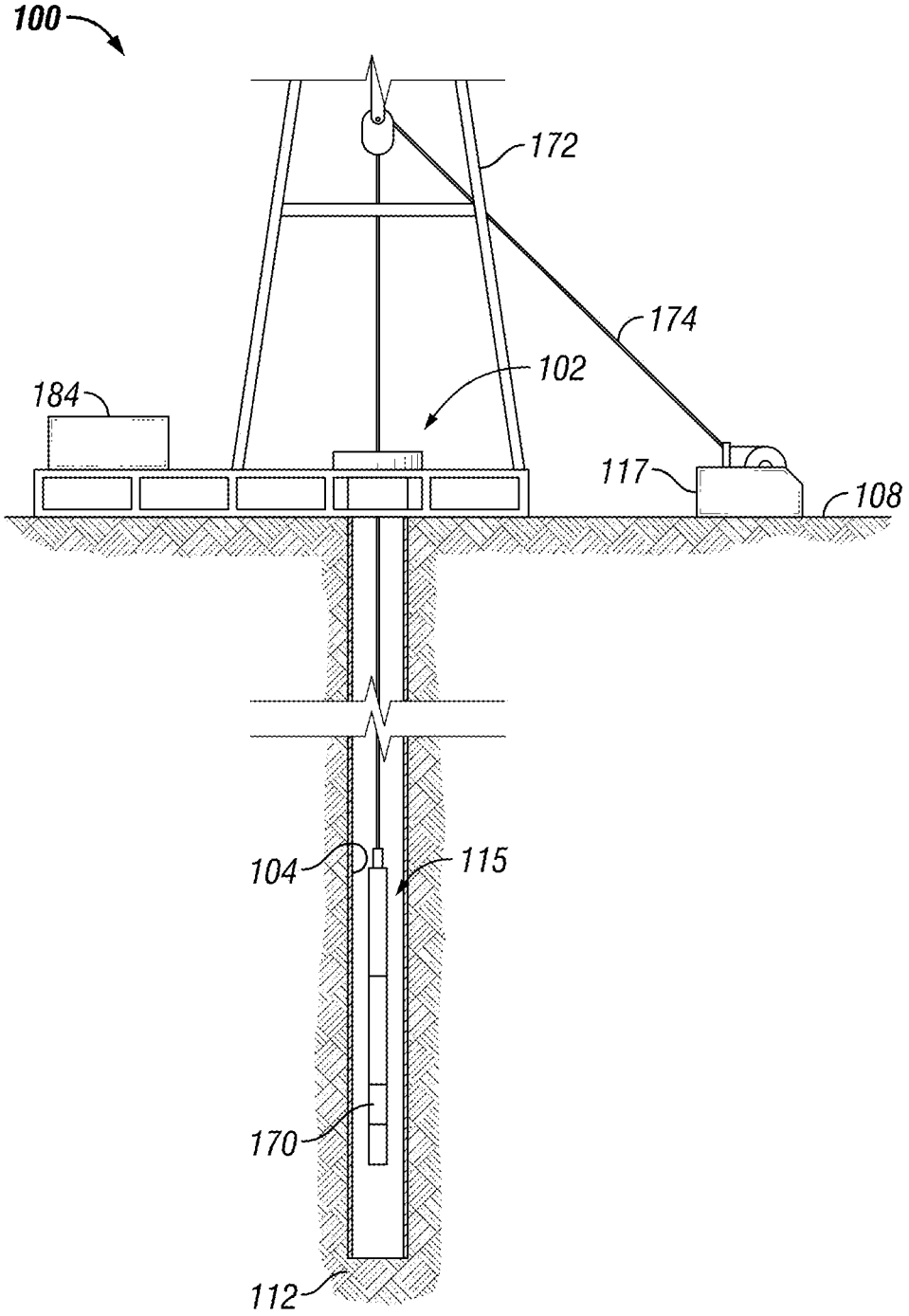
FIG. 1B illustrates a schematic view of another well in which an example embodiment of a fluid sample system is deployed.

Fluid sampling tool 170 may be tethered to winch 117 through wireline 174. While FIG. 1B illustrates wireline 174, it should be understood that other suitable conveyances may also be used for providing mechanical conveyance to fluid sampling tool in well 102, including, but not limited to, slickline, coiled tubing, pipe, drill pipe, drill string, downhole tractor, or the like. In some examples, the conveyance may provide mechanical suspension, as well as electrical connectivity, for fluid sampling tool 170. Wireline 174 may include, in some instances, a plurality of electrical conductors extending from winch 117. By way of example, wireline 174 may include an inner core of seven electrical conductors (not shown) covered by an insulating wrap. An inner and outer steel armor sheath may be wrapped in a helix in opposite directions around the conductors. The electrical conductors may be used for communicating power and telemetry downhole to fluid sampling tool 170.

With reference to both FIGS. 1A and 1B, operation of fluid sampling tool 170 for sample collection will now be described in accordance with example embodiments. Fluid sampling tool 170 may be raised and lowered into well 102 on drill string 120 (e.g., referring to FIG. 1A) and wireline 174 (e.g., referring to FIG. 1B). Fluid sampling tool 170 may be positioned downhole to obtain fluid samples from the subterranean formation 112 for analysis. The formation fluid and, thus the fluid sample may be contaminated with, or otherwise contain, the target component. In some embodiments, the target component may be contained in the fluid sample in small quantities, for example, less than 500 parts per million ("ppm"). Additionally, the target component may be present in the fluid sample in an amount from about 1 ppm to about 500 ppm, about 100 ppm to about 200 ppm, about 1 ppm to about 100 ppm, or about 5 to about 10 ppm. Fluid sampling tool 170 may be operable to measure, process, and communicate data regarding subterranean formation 112, fluid from subterranean formation 112, or other operations occurring downhole. After recovery, the fluid sample may be analyzed, for example, to quantify the concentration of the target component. This information, including information gathered from analysis of the fluid sample, allows well operators to determine, among other things, the concentration the target component within the fluid being extracted from subterranean formation 112 to make intelligent decisions about ongoing operation of well 102. In some embodiments, the data measured and collected by fluid sampling tool 170 may include, without limitation, pressure, temperature, flow, acceleration (seismic and acoustic), and strain data. As described in more detail below, fluid sampling tool 170 may include a communications subsystem, including a transceiver for communicating using mud pulse telemetry or another suitable method of wired or wireless communication with a surface controller 184. The transceiver may transmit data gathered by fluid sampling tool 170 or receive instructions from a well operator via surface controller 184 to operate fluid sampling tool 170.

Figure 2:
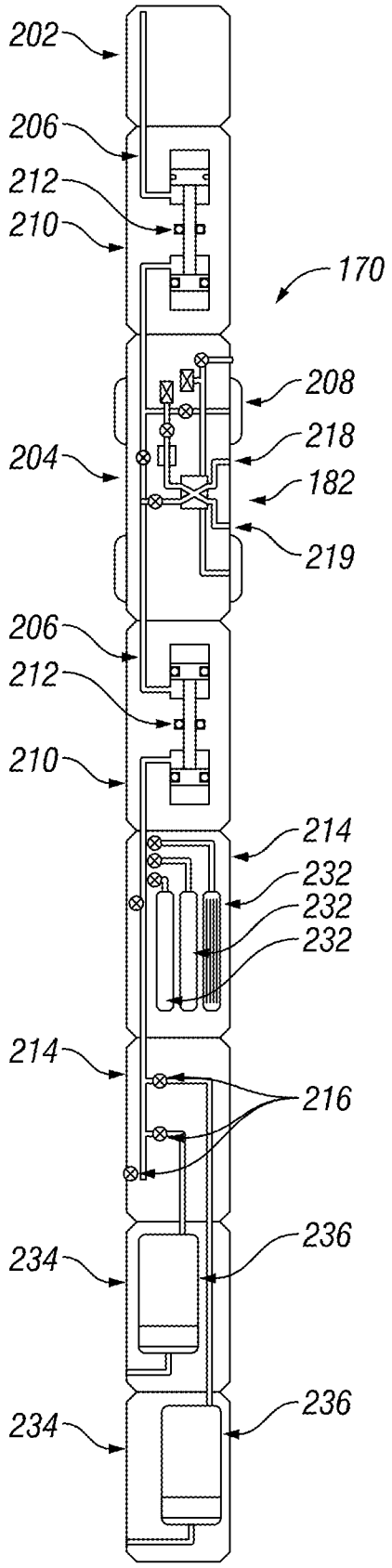
FIG. 2 illustrates a schematic view of an example embodiment of a fluid sampling tool.

Referring now to FIG. 2, an example embodiment of a fluid sampling tool 170 is illustrated as a tool for gathering fluid samples from a formation for subsequent analysis and testing. It should be understood that the fluid sampling tool 170 shown on FIG. 2 is merely illustrative and the example embodiments disclosed herein may be used with other tool configurations. In an embodiment, fluid sampling tool 170 includes a transceiver 202 through which fluid sampling tool 170 may communicate with other actuators and sensors in a conveyance (e.g., drill string 120 on FIG. 1A or wireline 174 on FIG. 1B), the conveyance's communications system, and with a surface controller (surface controller 184 on FIG. 1A). In an embodiment, transceiver 202 is also the port through which various actuators (e.g. valves) and sensors (e.g., temperature and pressure sensors) in fluid sampling tool 170 are controlled and monitored by, for example, a computer in another part of the conveyance or by surface controller 184. In an embodiment, transceiver 202 includes an information handling system that exercises the control and monitoring function.

In examples, the information handling system may connect to sensors and other devices by a communication link (which may be wired or wireless, for example) which may transmit data to information handling system. While the information handling system is disposed in transceiver 202, a second information handling system may be disposed at the surface. This may allow for data transmission from fluid sampling tool 170 to the surface in real time. Additionally, there may only be an information handling system at the surface, which receives data and measurements from fluid sampling tool 170 through a direct or wireless connection. In examples, the information handling system may include a personal computer, a video display, a keyboard (i.e., other input devices.), and/or non-transitory computer-readable media (e.g., optical disks, magnetic disks) that may store code representative of the methods described herein. Likewise, the information handling system may process measurements taken by one or more sensors automatically. During operations, software, algorithms, and modeling may be performed by the information handling system. The information handling system may perform steps, run software, perform calculations, and/or the like automatically, through automation (such as through artificial intelligence ("AI"), dynamically, in real-time, and/or substantially in real-time. The information handling system may be connected to all control systems and device to control all operations and functions of fluid sampling tool 170, as well as record, transmit, or process measurements and acquired data.

Fluid sampling tool 170 may include a packer assembly 204. In examples, packer assembly 204 may include one or more inflatable packers 208 that are attached to the outside of packer assembly 204. Inflatable packers 208 include at least a first inflatable packer 208*a* longitudinally spaced from a second inflatable packer 208*b* along packer assembly 204. During operations, inflatable packers 208 may be expanded and/or inflated (not illustrated). When inflatable packers 208 are expanded, inflatable packers 208 may seal a section within well 102 (e.g., referring to FIG. 1), and create an inflatable packer space 182 between inflatable packers 208. Inflatable packers 208 may trap fluid within inflatable packer space 182, where the fluid may be drilling fluid, or other downhole fluid.

As illustrated in FIG. 2, a channel 206 extends from one end of the fluid sampling tool 170 to the other. Channel 206 may be connected to other tools or portions of the fluid sampling tool 170 arranged in series. Fluid sampling tool 170 may also include a single or multiple flow-control pump-out section 210, which includes a pump 212 for pumping fluid through the channel 206. The fluid sampling tool 170 also includes one or more chambers, such as multi-chamber sections 214.

Figure 3:
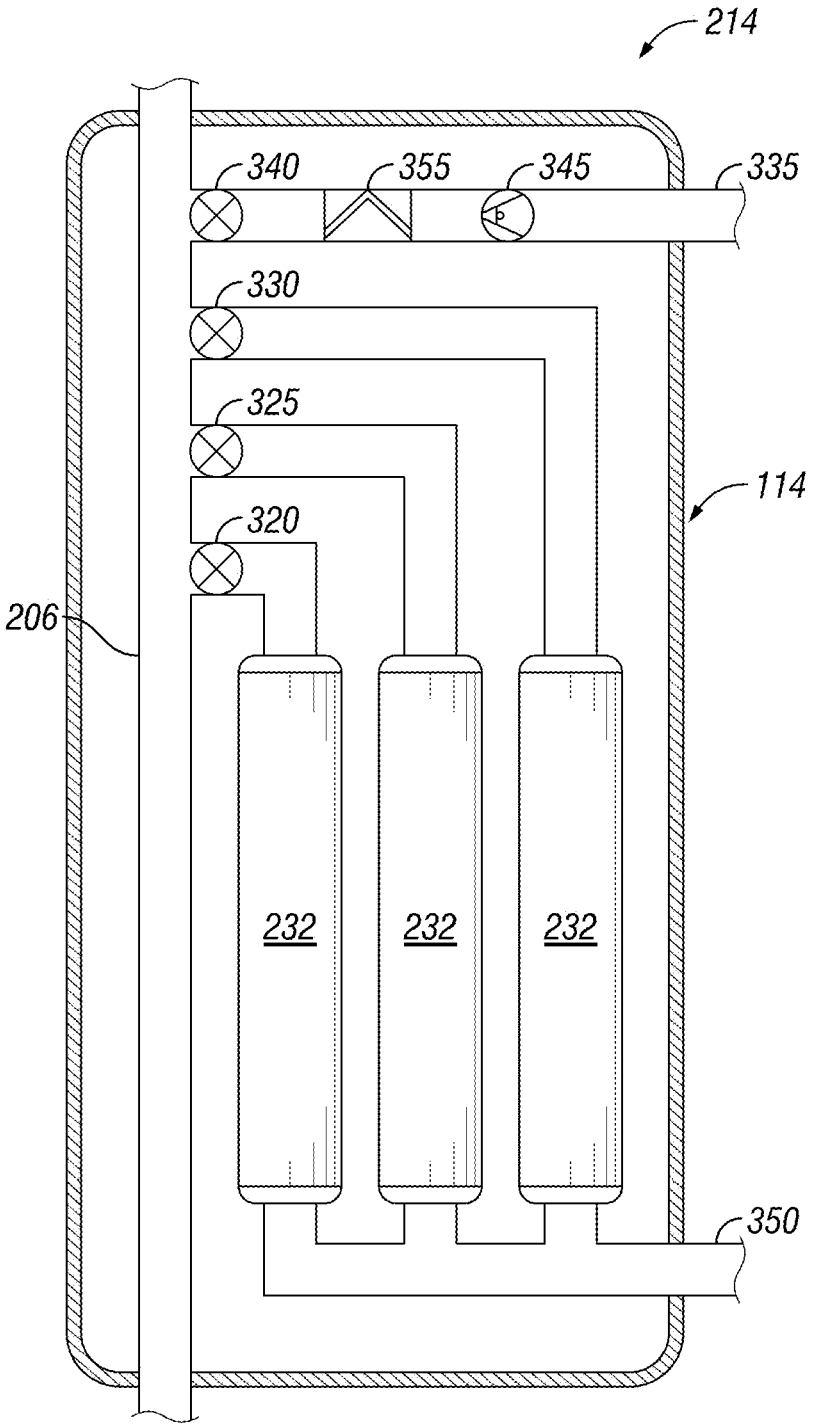
FIG. 3 illustrates an enlarged schematic view of an example embodiment the fluid sampling tool of FIG. 2.

With additional reference to FIG. 3, multi-chamber sections 214 include multiple sample chambers 232. While FIGS. 2 and 3 show the multi-chamber sections 214 having three sample chambers 232, it will be understood that multi-chamber sections 214 may have any number of sample chambers 232 and may in fact be single chamber sections. In some embodiments, sample chambers 232 may be coupled to channel 206 through respective chamber valves 320, 325, 330. Formation fluid may be directed from channel 206 to a selected one of sample chambers 232 by opening the appropriate one of chamber valves 320, 325, 330. Chamber valves 320, 325, 330 may be configured such that when one of chamber valves 320, 325, 330 is open the others are closed.

In some embodiments, multi-chamber section 214 may include a path 335 from channel 206 to annulus 160 through an annulus valve 340. Annulus valve 340 may be open during the draw-down period when fluid sampling tool 170 is clearing mud cake, drilling mud, and other contaminants into the annulus before clean formation fluid is directed to one of sample chambers 232. A check valve 345 may prevent fluids from annulus 160 from flowing back into channel 206 through path 335. As such, the multi-chamber sections 214 may include a path 350 from sample chambers 223 to annulus 160.

Referring back to FIG. 2, multi-chamber section 214 may be further connected to a storage section 234. In examples, there may be one or more storage sections 234, as illustrates there are two storage sections 234. Within storage section 234 may be a single storage tank 236. However, there may be multiple storage tanks 236 within storage section 234. In examples, storage tanks 236 may operate and function to hold stimulation fluids and release the stimulation fluids at an area of interest. During operations, storage tanks 236 may be controlled by chamber valve section "CVS" 214. CVS 214 controls the selection of which storage tank 236 may be opened or closed at the required time of operations. Controlling of the opening and closing of each storage tank 236 may be performed by one or more valves 216. When opened, stimulation fluids may be removed from each storage tank 236 separately or at the same time. Pump 212 may move stimulation fluid from storage tank 236 to channel 206, which may allow for stimulation fluid to move through fluid sampling tool 170 to packer assembly 204. The stimulation fluid may be expelled through one or more exhaust ports 218 and 219 in packer 204. With one or more inflatable packers 208 deployed, inflatable packer space 182 may allow for stimulation fluid to target a specific zone of interest in a formation. The stimulation fluid may be injected directly into the formation or may be placed within the area separated by packer 204 but not directly injected into the formation.

During sampling operations, as discussed above, an objective may be to obtain fluid and rock properties. However, in ultra-tight/secondary reservoir current methods may not be applicable. Specifically, the rock formation may not allow for fluid sampling and analysis system 100 to draw fluid from subterranean formation 112 (e.g., referring to FIG. 2). To perform sampling operations, stimulation fluids may be carried to a zone of interest in which sampling operations may be performed. Stimulation fluids may include different acid types and concentrations such as and not limited to HCL or H2SO4 which is known by its enhancement effects for certain rock types due to its chemical reaction causing an increase in the rock porosity and therefore rock permeability. Another stimulation fluid is Alkaline Surfactant Polymers (ASP), which is known by its effect of altering rock wettability causing an enhancement for better fluid movement and productivity, viscosity reducers chemicals which helps in reducing the hydrocarbon viscosity to ease its flow into the sampling tool, and/or the like. Most stimulation fluid is known by its corrosive behavior, which require a special treatment by using and designing specific inhibitor blends such as (HAI-85M) to inhibit acid corrosion of storage tanks 236 within fluid sampling tool 170. The stimulation fluid may contain any number of combination of surfactants, solvents and dispersants that enables it to provide corrosion protection in acid at temperatures up to 177° C. against the tool interiors while preserving its chemical properties for targeted reservoir enhancement.

Holding the stimulation fluids and inhibitors within fluid sampling and analysis system 100 allows for precisely targeting the required zone of interest with a pre-designed interval spacing and stimulation fluid volume to be injected as well as monitoring downhole pressure improvement while stimulating followed by a flow-back for reservoir fluid sampling and characterization. Different stimulation fluid(s) may be carried downhole within fluid sampling tool 170 in well 102 for comparison/studying its effect. In addition, for reservoirs with no injectivity, the technique may allow for the placement of the stimulation fluid facing the zone of interest within inflatable packer space 182 without direct injectivity. This may allow the stimulation fluid to start its chemical reaction of rock's enhancement that will lead to possible injectivity of the remaining stimulation fluid carried within fluid sampling and analysis system 100 for further enhancement.

Figure 4A:
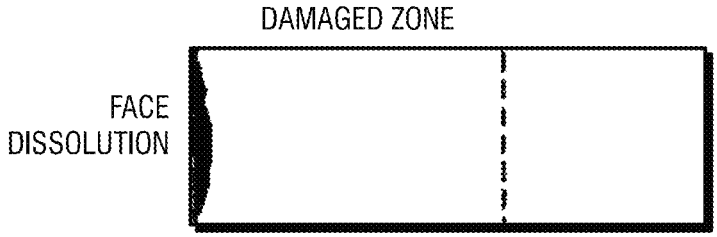
FIGS. 4A-4E illustrated side views of different types of etching in a formation.
Figure 4B:
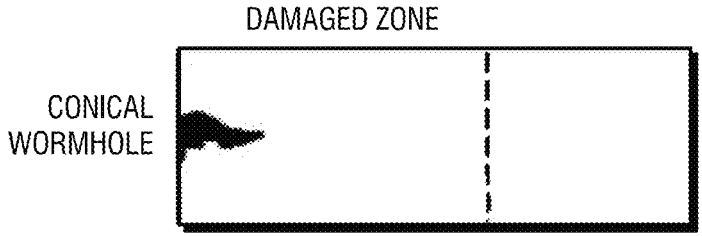
Figure 4C:
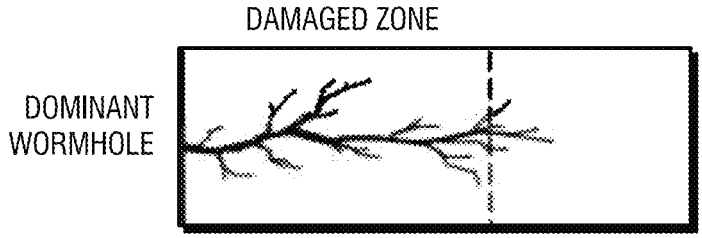
Figure 4D:
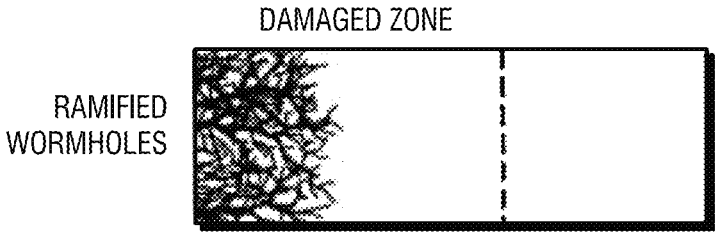
Figure 4E:
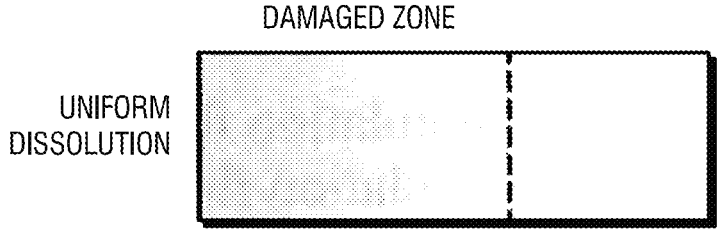
Figure 5A:
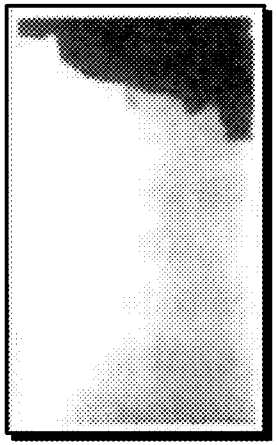
FIGS. 5A-5E illustrate a cross section of each view in FIGS. 4A-4E.
Figure 5B:
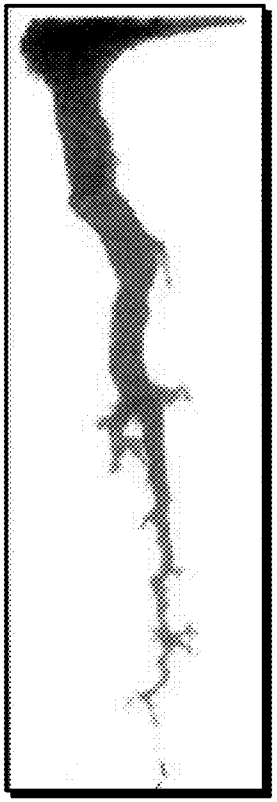
Figure 5C:
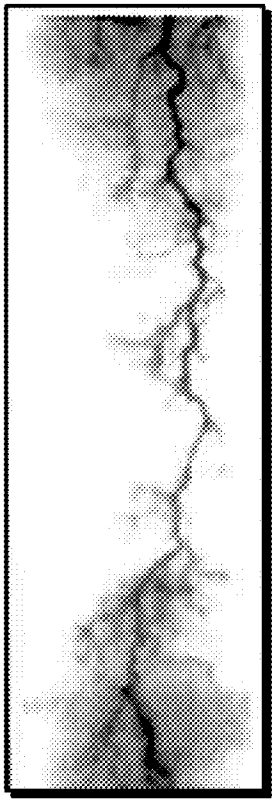
Figure 5D:
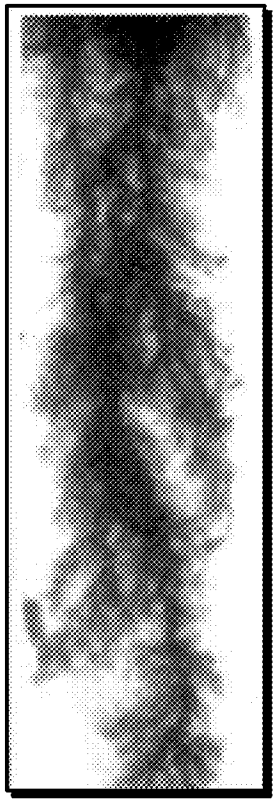
Figure 5E:
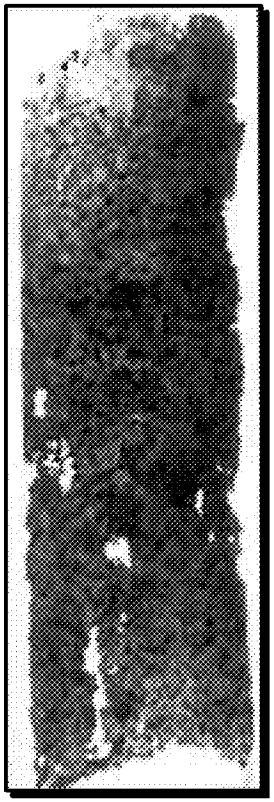

Application of the stimulation fluids to subterranean formation 112 may allow for the simulation fluids to etch into subterranean formation 112. Results from the application of stimulation fluids to subterranean formation 112 are illustrated in FIGS. 4A-4E. FIGS. 4A-4E illustrate side views of different types of etching. For example, FIG. 4A illustrates face dissolution which is considered as "acid wash" using limited volume of acid and low injection rate to clean the rock face and remove formation skin damage, it may also be caused by non-optimum acid concentration. FIGS. 4B to 4D illustrates different wormholes patterns which are depended on acid concentration, injection rate and ability of rapid rock reaction to the acid. Acid propagate depending on that from conical, dominated, to ramified wormholes in order illustrating the different possible shapes and efficiency. FIG. 4E illustrates uniform dissolution which is a possible rock reaction at high injection rate of acid allowing low residence time which cause the rock to dissolve more uniformly. FIG. 5A-5E are cross sections of each type of etching described above. During operations, conical wormhole in FIG. 5B and dominant wormhole in FIG. 5C may enhance sampling operations.

Figure 6A:
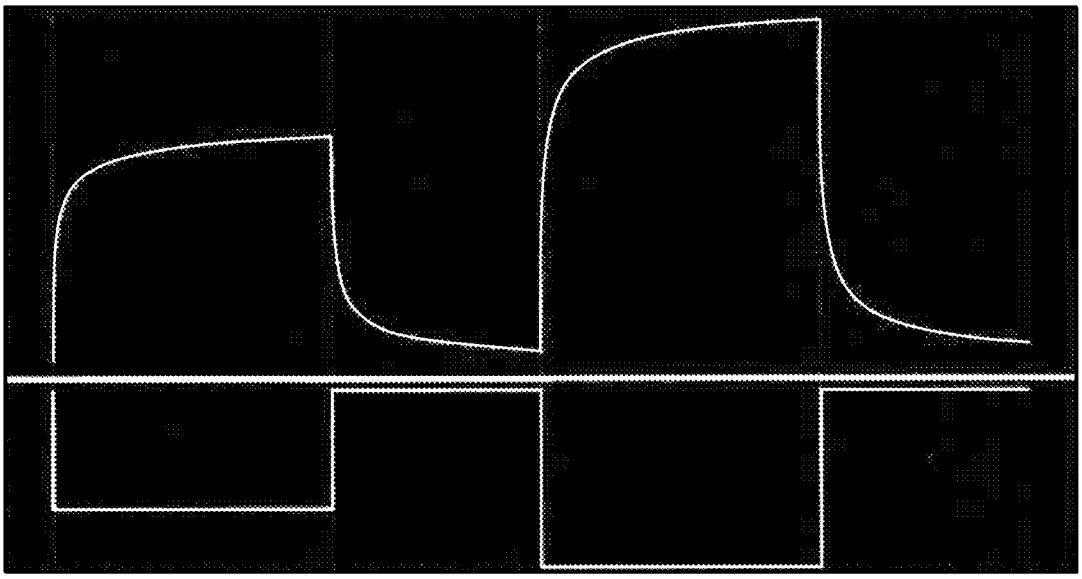
FIGS. 6A and 6B illustrate pre-job pressure-rate simulations.
Figure 6B:
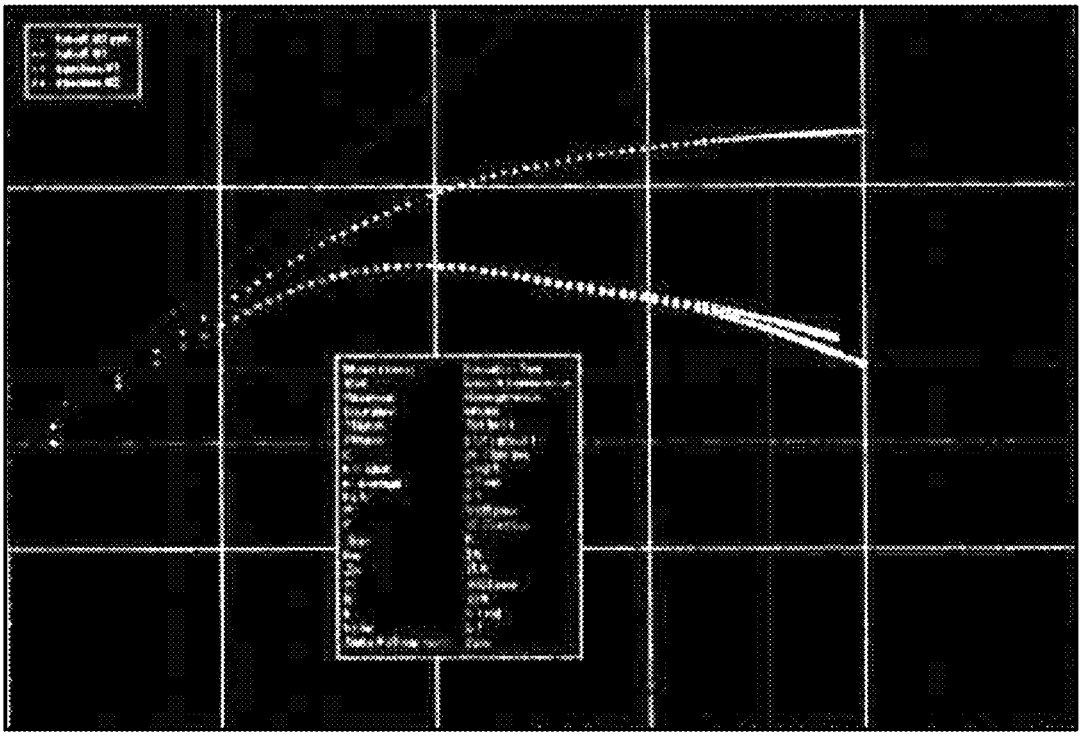

FIGS. 6A and 6B illustrate a pre-job pressure-rate simulation taking into consideration the reservoir expected properties (or measured via open hole logs, caliper, corrosion, and cement image logs). In order to predict possible acid injection rates and pressure. FIGS. 6A and 6B may be used in conjunction with logs to design an acid for the stimulation fluid and concentration as well as predicting the type of wormhole to be created and the degree of reservoir enhancement.

Figure 7A:
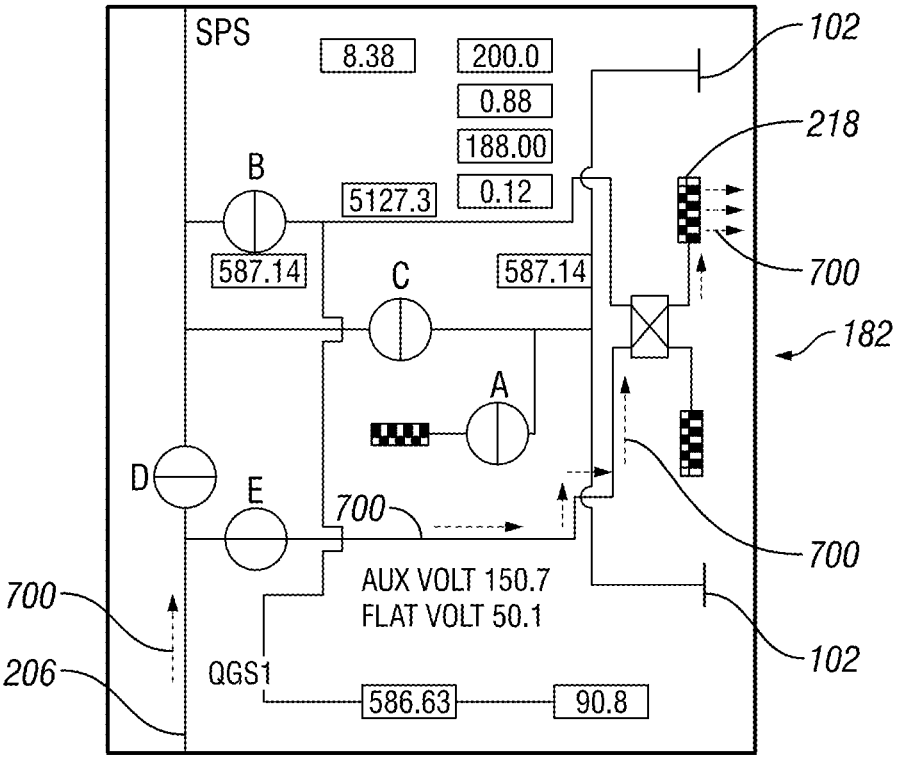
FIGS. 7A and 7B illustrate a schematic of a packer assembly that includes one or more ports, during stimulation operations.
Figure 7B:
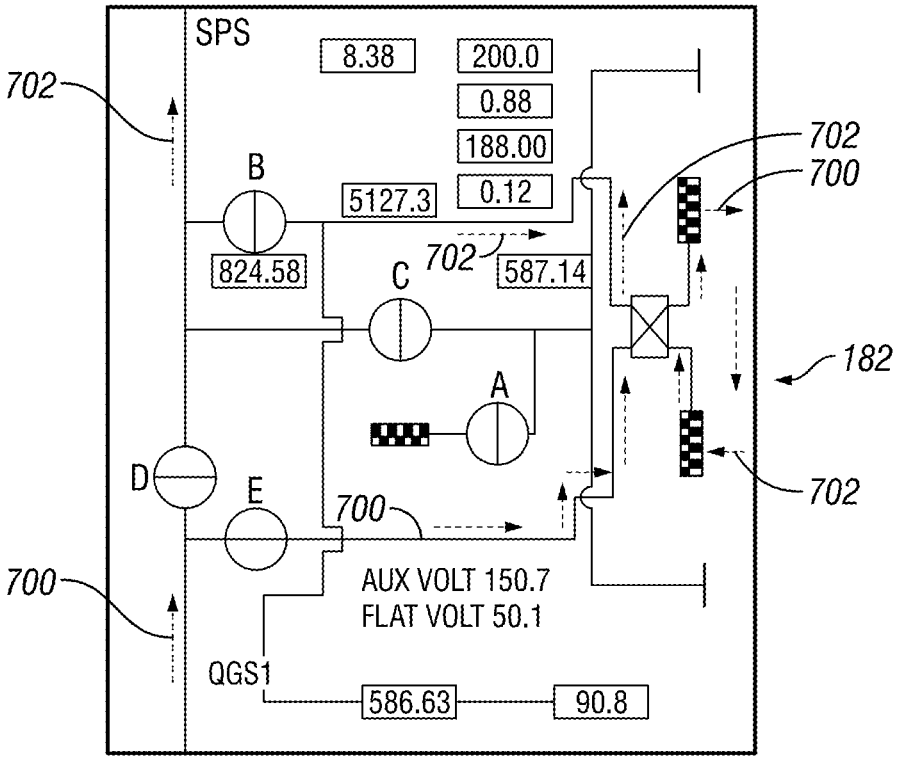

FIG. 7A illustrate a schematic of packer assembly 204. Illustrated schematically are inflatable packers 208*a* and 208*b* and channel 206. As discussed above, stimulation fluid 70) moves through packer assembly 204 by traversing through channel 206, where stimulation fluid 700 is redirected through one or more flow lines by one or more valves to exhaust port 218. As illustrated in FIG. 7A, a case of minimum required injectivity is achievable while the upper part of the tool flow-line is completely isolated from the acid/mud through valve B. FIG. 7B illustrates another example in which mud 702, disposed between inflatable packers 208 through exhaust port 219, is removed and replaced by stimulation fluid 700 through exhaust port 218. This operation may be performed in case of no injectivity into the formation due to tightness by injecting the acid from storage tanks 236 (e.g., referring to FIG. 2) through valve E. This may push mud 702 from the packed interval by opening valve B, allowing stimulation fluid 700 to face the formation by measuring the exact mud volume of replaced mud 702 by stimulation fluid 700 in order to start a chemical reaction and stimulation process. After a specific soaking period of stimulation fluid 700 within inflatable packer space 182, valve B is closed, and an acid injection process starts similar to what is illustrated in FIG. 7A. In examples, the soaking period may range from thirty minutes to one hour or twenty minutes to an hour and a half.

Figure 8:
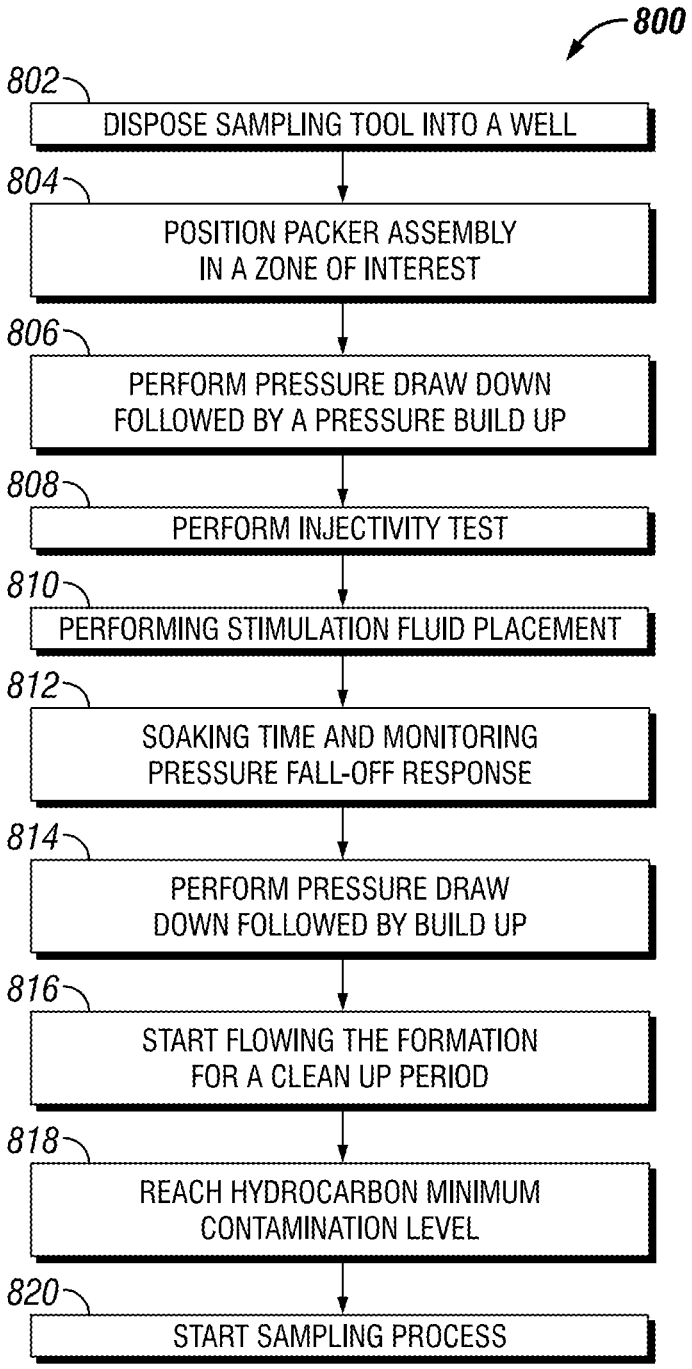
FIG. 8 is a flowchart for stimulating a formation.

FIG. 8 illustrates a flow chart 800 for performing a sampling operation in an ultra-tight formation. Flow chart 800 may begin with block 802, in which fluid sampling tool 170 (e.g., referring to FIGS. 1 and 3) is disposed in well 102 (e.g., referring to FIGS. 1 and 2). In block 804, a packer assembly 204 (e.g., referring to FIG. 3) is positioned in a zone of interest. This may be performed by lowering fluid sampling tool 170 to an identified zone of interest that may be an ultra-tight formation. Additionally, within block 804, inflatable packers 208 (e.g., referring to FIG. 3) are activated to isolate the zone of interest.

After isolating as zone of interest in block 804, a pressure draw down and pressure build up operation is performed in block 806. A pressure draw down is performed using low-control pump-out section 210, by dropping the pressure within inflatable packer inflatable packer space 182 using pump 212. Next a pressure build is performed by stopping low-control pump-out section 210 and pump 212, allowing the formation pressure to stabilize indicating reservoir pressure, flowing mobility and build up permeability.

Next, in block 808 an injectivity test is performed by using low-control pump-out section 210 and reversing the flow direction from draw-down to injection using pump 212. This may increase the pressure in inflatable packer space 182 gradually with a controlled rate to explore the possible injectivity rate vs. pressure.

After an injectivity test is performed in block 808, a direct stimulation fluid of stimulation fluid placement is performed in block 810. The operation of applying the stimulation fluid to a formation is discussed above in FIGS. 7A and 7B. After the placement of stimulation fluid in block 812 a soaking time for the stimulation fluid is run and monitoring of a pressure fall-off response is performed. Monitoring of pressure fall-off is performed at inflatable packer space 182 while the pressure is leaking off into a matrix until the pressure stabilizes and is recorded as the formation pressure. Specifically, the monitoring is performed by a sensor, identified in FIGS. 7A and 7B as "QGS1."

In block 814 another pressure draw down is performed followed by a pressure build up. By performing pressure drawdown and build up before and after deployment of a stimulation fluid, the degree of reservoir enhancement may be found. This may be done by comparing flow pressure and rate before and after as well as the buildup mobility from both tests. Comparing the flow press and rate may be performed by look at the difference in the numbers before and after or by performing an advanced analytical solution for pressure derivative. Additionally, build up mobility may be found by the use of the Darcy equation (e.g., referring to Equation 1), or by utilizing as mentioned above, pressure transient analysis technique using the pressure derivative.

In block 816 a clean-up period is performed where flow from the formation is retrieved for a set time. In block 818, during the clean-up period, hydrocarbon contamination of the fluid is measured. Once a minimum contamination level of hydrocarbons is met, a sampling process is performed in block 820. It should be noted that flow chart 800 may then be repeated any number of times with any number of stimulation fluids.

Current technology does not include the systems and methods for a fluid sampling and analysis system 100 (e.g., referring to FIG. 1) discussed above. Specifically, current technology does not utilize in situ stimulation followed by sampling technique. As discussed above, custom stimulation fluids may be utilized and even a mix of different types may be carried downhole to be tested in-situ for its improvement effects by performing Test-Inject-Test technique. Fluid sampling and analysis system 100, as described above, may identify reservoir fluid type, locate fluid contacts, calculate formation fluid mobility based off the sample being extracted, collect representative reservoir fluid samples, analyze reservoir fluids in situ, and identify best stimulation treatment by performing in-situ testing for proposed fluids. For example, one or more types of stimulation fluids may be disposed in separate storage tanks 236. These stimulation fluids may carry different acid type, concentrations, injection rate or volumes may give a diverse results which may be measured in real-time under in-situ conditions by utilizing test-inject-test methodology pin pointing the improvement degree at each combination recommending treatment for an identified reservoir/rock type in a formation.

Statement 1: A fluid sampling tool may comprise a packer assembly that includes one or more inflatable packers and one or more exhaust ports, a multi-chamber section that includes one or more sample chambers, at least two storage sections that each contain a storage tank, wherein each storage tank holds a stimulation fluid, and a channel that connects the packer assembly, the multi-chamber section, and the at least two storage sections. The system may further include a pump that is configured to move the stimulation fluid through the channel to the packer assembly and out the one or more exhaust ports.

Statement 2: The fluid sampling tool of statement 1, wherein each storage tank holds the stimulation fluid or a second stimulation fluid.

Statement 3: The fluid sampling tool of statements 1 or 2, wherein the stimulation fluid includes one or more inhibitors.

Statement 4: The fluid sampling tool of statements 1, 2 or 3, wherein the stimulation fluid etches at least one wormhole into a formation.

Statement 5: The fluid sampling tool of statements 1 or 2-4, wherein the stimulation fluid includes HCL, H2SO4, Alkaline Surfactant Polymers, or viscosity reducers.

Statement 6: The fluid sampling tool of statements 1 or 2-5, wherein the packer assembly is further configured to isolate a zone of interest with one or more inflatable packers.

Statement 7: The fluid sampling tool of statement 6, wherein the packer assembly is further configured to remove fluid from the zone of interest.

Statement 8: The fluid sampling tool of statement 7, wherein the packer assembly is further configured to add the stimulation fluid to the zone of interest.

Statement 9: The fluid sampling tool of statements 1 or 2-6, wherein the packer assembly is further configured to remove a fluid from a zone of interest.

Statement 10: The fluid sampling tool of statement 9, wherein the fluid is stored in the one or more sample chambers.

Statement 11: A method for performing a stimulation operation may comprise disposing a fluid sampling tool into a well, moving the fluid sampling tool to a zone of interest, isolating the zone of interest with a packer assembly on the fluid sampling tool, performing a first pressure draw down and a first pressure build up, and performing an injectivity test. The method may further comprise placing a stimulation fluid into the zone of interest, performing a section pressure draw down and a second pressure build up, and performing a sampling process.

Statement 12: The method of statement 11, further comprising performing a clean up period in which a fluid from a formation is captured by the fluid sampling tool.

Statement 13: The method of statement 12, further comprising measuring a hydrocarbon contamination level in the fluid.

Statement 14: The method of statements 11 or 12, further comprising comparing the first pressure draw down and the first pressure build up to the second pressure draw down and the second pressure build up to determine a reservoir enhancement from the stimulation fluid in the zone of interest.

Statement 15: The method of statements 11, 12, or 14, wherein the placing a stimulation fluid into the zone of interest includes moving the stimulation fluid from a storage tank within the fluid sampling tool to the zone of interest through the packer assembly.

Statement 16: The method of statement 15, wherein the stimulation fluid etches into a formation.

Statement 17: The method of statement 16, wherein the formation is an ultra-tight formation.

Statement 18: The method of statements 11 or 12-15, wherein the placing the stimulation fluid into the zone of interest is performed during a soaking time, wherein the soaking time is a time in which the stimulation fluid is exposed to a formation.

Statement 19: The method of statement 18, further comprising monitoring a pressure fall-off response during the soaking time.

Statement 20: The method of statements 11, 12-15, or 18, wherein the zone of interest is a tight formation.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite arrange not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A fluid sampling tool comprising:

a packer assembly that includes one or more inflatable packers and one or more exhaust ports;

a multi-chamber section that includes one or more sample chambers;

at least two storage sections that each contain a storage tank; wherein each storage tank holds a fluid consisting of a stimulation fluid and one or more inhibitors;

a channel that connects the packer assembly, the multi-chamber section, and the at least two storage sections; and a pump that is configured to move the stimulation fluid through the channel to the packer assembly and out the one or more exhaust ports.

2. The fluid sampling tool of claim 1, wherein each storage tank holds the stimulation fluid or a second stimulation fluid.

3. The fluid sampling tool of claim 1, wherein the stimulation fluid etches at least one wormhole into a formation.

4. The fluid sampling tool of claim 1, wherein the stimulation fluid includes HCL, H2SO4, Alkaline Surfactant Polymers, or viscosity reducers.

5. The fluid sampling tool of claim 1, wherein the packer assembly is further configured to isolate a zone of interest with one or more inflatable packers.

6. The fluid sampling tool of claim 5, wherein the packer assembly is further configured to remove fluid from the zone of interest.

7. The fluid sampling tool of claim 6, wherein the packer assembly is further configured to add the stimulation fluid to the zone of interest.

8. The fluid sampling tool of claim 1, wherein the packer assembly is further configured to remove a fluid from a zone of interest.

9. The fluid sampling tool of claim 8, wherein the fluid is stored in the one or more sample chambers.

10. A method for performing a stimulation operation comprising:

disposing a fluid sampling tool into a well, wherein the fluid sampling tool contains a fluid consisting of a stimulation fluid and one or more inhibitors;

moving the fluid sampling tool to a zone of interest;

isolating the zone of interest with a packer assembly on the fluid sampling tool;

performing a first pressure draw down and a first pressure build up;

performing an injectivity test;

placing the fluid into the zone of interest;

performing a section pressure draw down and a second pressure build up; and performing a sampling process.

11. The method of claim 10, further comprising performing a clean up period in which a fluid from a formation is captured by the fluid sampling tool.

12. The method of claim 11, further comprising measuring a hydrocarbon contamination level in the fluid.

13. The method of claim 10, further comprising comparing the first pressure draw down and the first pressure build up to the second pressure draw down and the second pressure build up to determine a reservoir enhancement from the stimulation fluid in the zone of interest.

14. The method of claim 10, wherein the placing a stimulation fluid into the zone of interest includes moving the stimulation fluid from a storage tank within the fluid sampling tool to the zone of interest through the packer assembly.

15. The method of claim 14, wherein the stimulation fluid etches into a formation.

16. The method of claim 15, wherein the formation is an ultra-tight formation.

17. The method of claim 10, wherein the placing the stimulation fluid into the zone of interest is performed during a soaking time, wherein the soaking time is a time in which the stimulation fluid is exposed to a formation.

18. The method of claim 17, further comprising monitoring a pressure fall-off response during the soaking time.

19. The method of claim 10, wherein the zone of interest is a tight formation.

* * * * *